US007743438B2

(12) United States Patent
Chen

(10) Patent No.: US 7,743,438 B2
(45) Date of Patent: Jun. 29, 2010

(54) ANCHOR STRUCTURE FOR SENSORS OF FAUCETS

(76) Inventor: Jan-Sun Chen, 3F, No. 42, Sing-Zhong Rd, Nei-Hu, Taipei City, 114 (TW)

( * ) Notice: Subject to any disclaimer, the term of this patent is extended or adjusted under 35 U.S.C. 154(b) by 779 days.

(21) Appl. No.: 11/646,311

(22) Filed: Dec. 28, 2006

(65) Prior Publication Data

US 2008/0156384 A1 Jul. 3, 2008

(51) Int. Cl.
*E03C 1/05* (2006.01)

(52) U.S. Cl. ..... 4/623; 137/801

(58) Field of Classification Search ..... 4/302–305, 4/623, 313; 137/801; 251/129.04; 24/16 R
See application file for complete search history.

(56) References Cited

U.S. PATENT DOCUMENTS 3,701,303 A * 10/1972 Kondo ..... 411/518
5,586,746 A * 12/1996 Humpert et al. ..... 251/129.04
6,082,407 A * 7/2000 Paterson et al. ..... 137/801
6,219,857 B1 * 4/2001 Wu ..... 4/623
6,671,898 B1 * 1/2004 Eggenberger et al. ..... 4/623

* cited by examiner

*Primary Examiner*—Khoa D Huynh
*Assistant Examiner*—Janie Christiansen
(74) *Attorney, Agent, or Firm*—Birch, Stewart, Kolasch & Birch, LLP

(57) ABSTRACT

An anchor structure for sensors of faucets is located in a sensing faucet. The sensor has a detection side and at least one notch on another side opposite to the detection side at an elevation same as an annular groove formed on an inner wall of a faucet body. An elastic clipping ring is provided to latch in the annular groove and the notch of the sensor to form a bucking effect to anchor the sensor at a selected location in the faucet. The elastic clipping ring is hollow and annular to provide a passage for watering piping and electric wiring. The structure is simpler and can be installed and removed rapidly.

14 Claims, 6 Drawing Sheets

ANCHOR STRUCTURE FOR SENSORS OF FAUCETS

BACKGROUND OF THE INVENTION

1. Field of the Invention

The present invention relates to an anchor structure and particularly to an anchor structure for sensors of faucets to facilitate fast installation and removing of the sensors.

2. Description of the Prior Art

Conventional sensing faucets generally have a faucet body to couple with a sensor and a water supply device. The sensor can detect the presence and leaving of users to output a control signal to the water supply device to activate or disable a solenoid valve housed in the water supply device to supply water or stop water supply in an automatic manner.

Because the sensing faucet has to include the sensor and the solenoid valve in the water supply device, and the sensor and solenoid valve have to be connected electrically through conductive wires, the internal structure is more complicated than the conventional plain faucet. Moreover, the conventional sensor has a detection side or has to be wedged in an exposed port formed on the faucet body to detect user's presence with a greater sensitivity. But coupling by embedding is not secured. Other anchoring means have to be used to form a secure coupling without loosening off easily. The commonly used anchoring means at present include bonding the sensor to the faucet body through adhesive, fastening a screw through the faucet body to press the back side of the sensor, forming a tray seat on the bottom of the faucet to integrate the sensor and the piping of the water supply device, and forming a trough seat by casting on the inner wall of the faucet body to hold the sensor. Whatever the approach being adopted for anchoring the sensor, it is necessary to take into account installation and fastening issues such as bypassing the piping routes of water and electricity in the faucet. Due to the complicated structure inside the sensing faucet, fabrication difficulty and cost increase. The complex anchoring method also makes repairs and maintenance of the sensing faucet more difficult and time-consuming, such as removing of the adhesive or disassembling of too many elements.

SUMMARY OF THE INVENTION

The primary object of the present invention is to provide a simple anchor structure for sensors to overcome the problems occurred to the conventional sensing faucets such as complex structure, time-consuming efforts needed to do installation or disassembly for repairs and maintenance.

To achieve the foregoing object, the anchor structure for sensors of faucets of the invention is located in a sensing faucet. The faucet houses a water supply valve and a sensor. The sensor has a detection side located in a port formed on a faucet body. The invention includes the following features: the faucet has an annular groove on an inner wall where the port is located; the sensor has at least one notch on one side opposite to the detection side; the notch is located at the same elevation level of the annular groove; and an elastic clipping ring is provided to be wedged in the annular groove and the notch of the sensor to form a multi-point bucking effect to anchor the sensor on a selected location in the faucet. In addition, while the sensor is anchored inside the faucet, the hollow annular elastic clipping ring forms a passage to allow the water piping and electric wires to pass through so that internal piping layout of the faucet is simpler. In the event that the sensor malfunctions and removal of the sensor is required for repairs, the sensor and the faucet body can be disengaged easily through the elastic clipping ring, and removal can be done rapidly.

The foregoing, as well as additional objects, features and advantages of the invention will be more readily apparent from the following detailed description, which proceeds with reference to the accompanying drawings.

DESCRIPTION OF THE PREFERRED EMBODIMENTS

Figure 1:
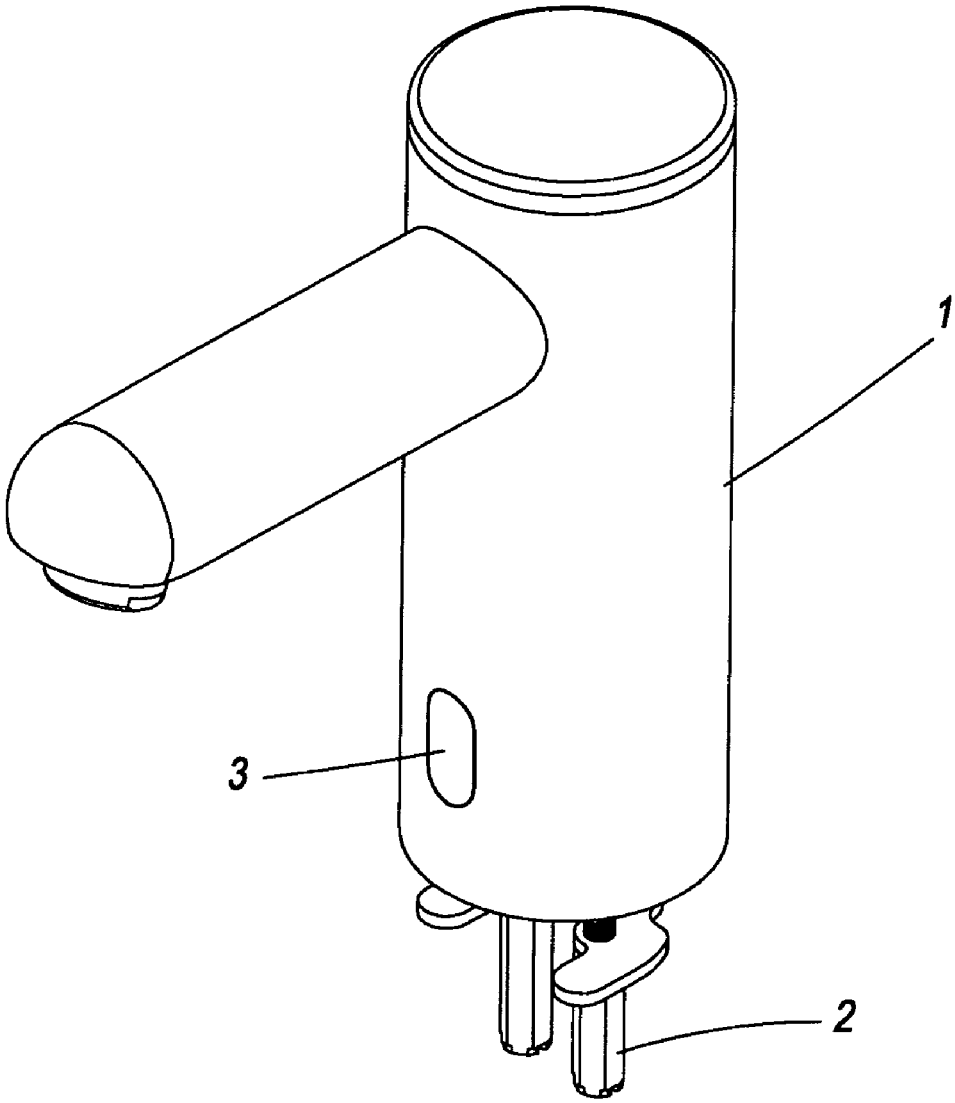
FIG. 1 is a perspective view of a sensing faucet.

Referring to FIGS. 1 through 4, the anchor structure for sensors of faucets according to the invention is adopted for use on a sensing faucet 1 which contains a water supply valve 2, a sensor 3 and an elastic clipping ring 4.

Figure 3:
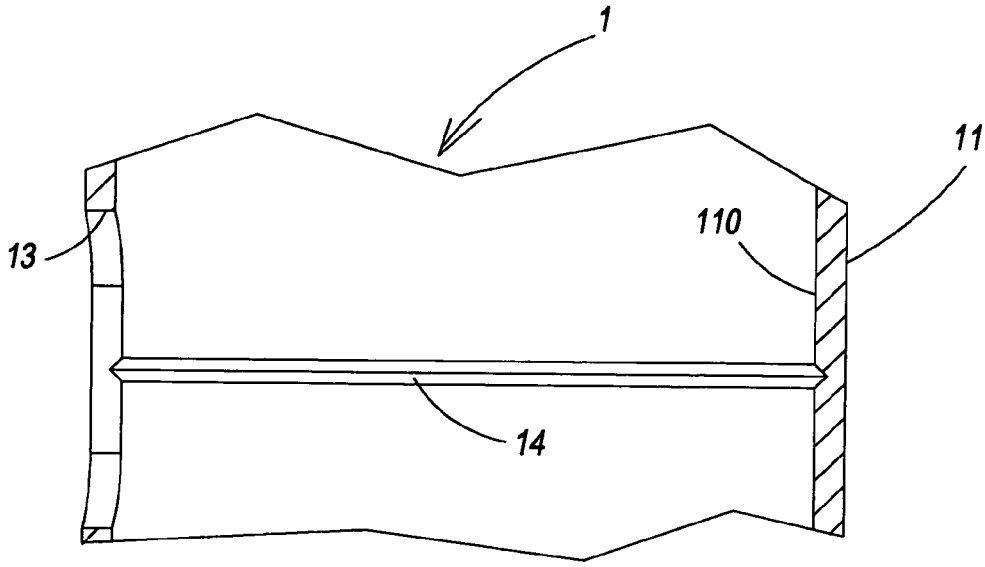
FIG. 3 is a fragmentary sectional view of the faucet body of an embodiment of the invention.

The faucet 1 has a hollow body 11 and a spout 12 connecting to the body 11. The body 11 has a port 13 on a selected location and an inner wall 110. In an embodiment of the invention an annular groove 14 is formed inside the body corresponding to where the port 13 is located as shown in FIG. 3. The annular groove 14 is preferably an indented annular groove formed on the inner wall 110 with a cross section of a saw, a curve, a rectangle or any other geometric shapes desired.

The water supply valve 2 likes the one used in the ordinary sensing faucet, and has at least one water intake end 21 connecting to an external water supply piping and an output end 22 connecting to the spout 12 of the faucet 1, and a solenoid valve 23 to control water to flow from the intake end 21 to the spout 12 through the output end 22.

Figure 4:
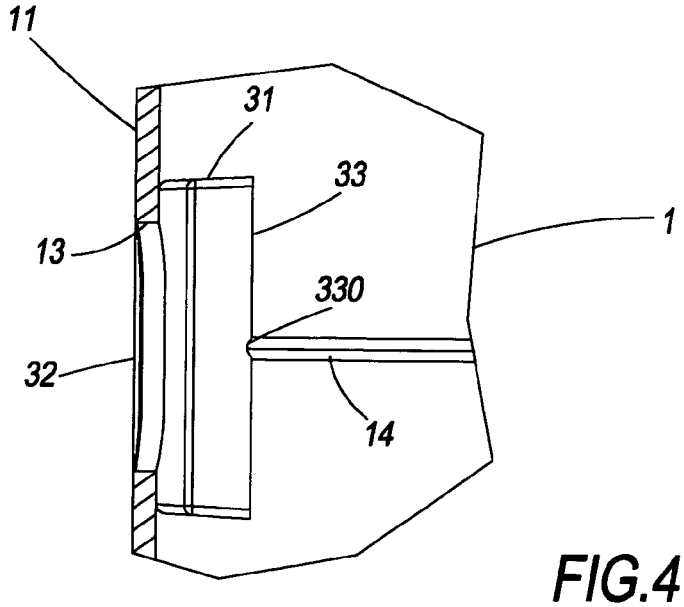
FIG. 4 is a schematic view of the sensor of an embodiment of the invention.

The sensor 3 has a shell 31 which has a detection side 32 on one side preferably formed in a shape mating the port 13 so that they can be coupled together by wedging. The shell 31 has another side opposing the detection side 32 to form an anchor side 33 which has at least one notch 330 as shown in FIG. 4. The notch 330 is formed at an elevation same as the annular groove 14. The notch 330 may be formed in a shape of a saw, a curve, a rectangle or any other geometric shapes desired. Beside the notch 330, a cavity or the like (not shown in the drawings) may also be formed on the anchor side 33.

Figure 2:
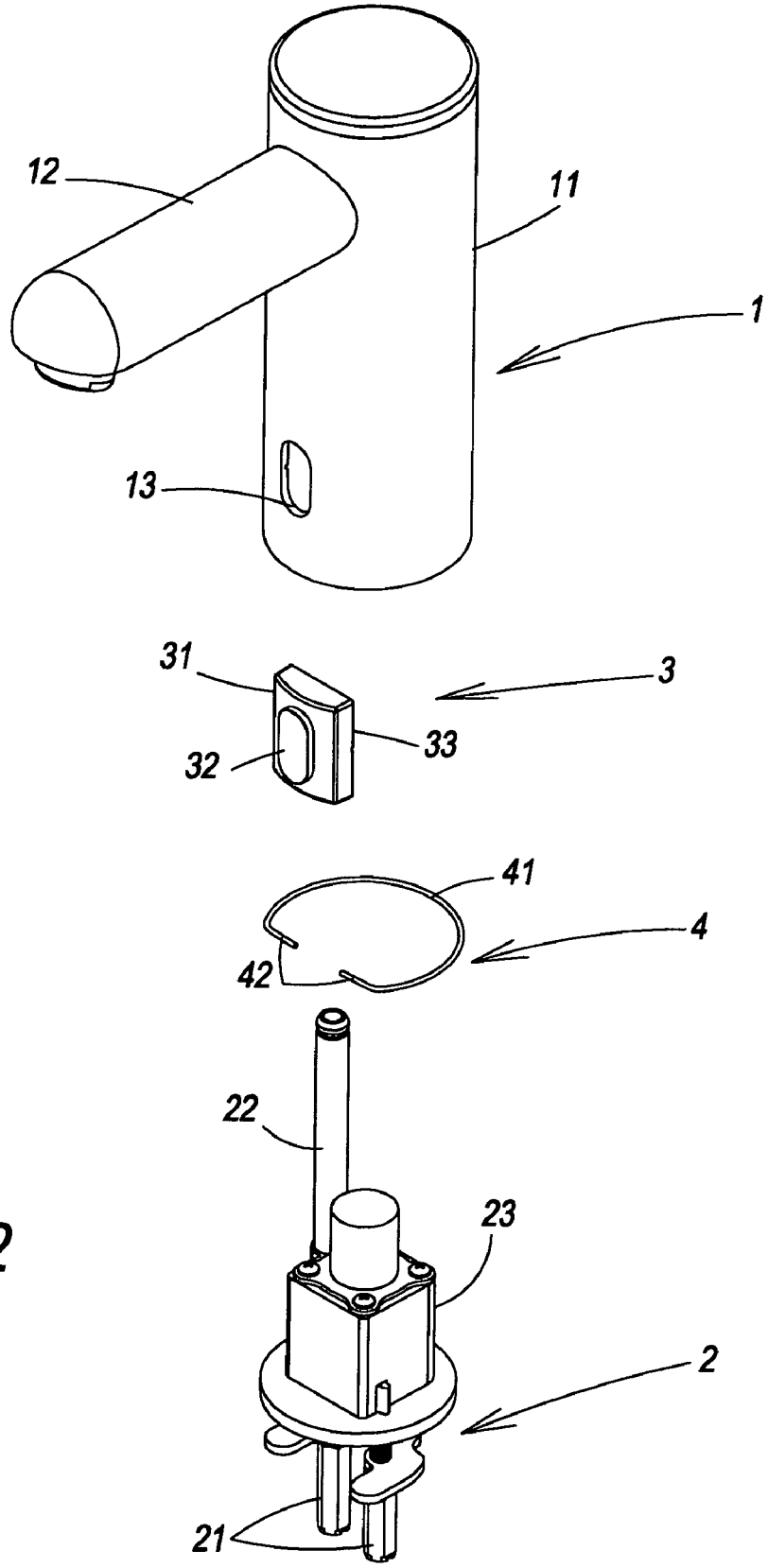
FIG. 2 is an exploded view of an embodiment of the invention.

The elastic clipping ring 4 is a non-closed annular elastic element with an opening as shown in FIG. 2. It has an annular closed portion 41 which has two ends opposing each other to form an opening 42.

Figure 5:
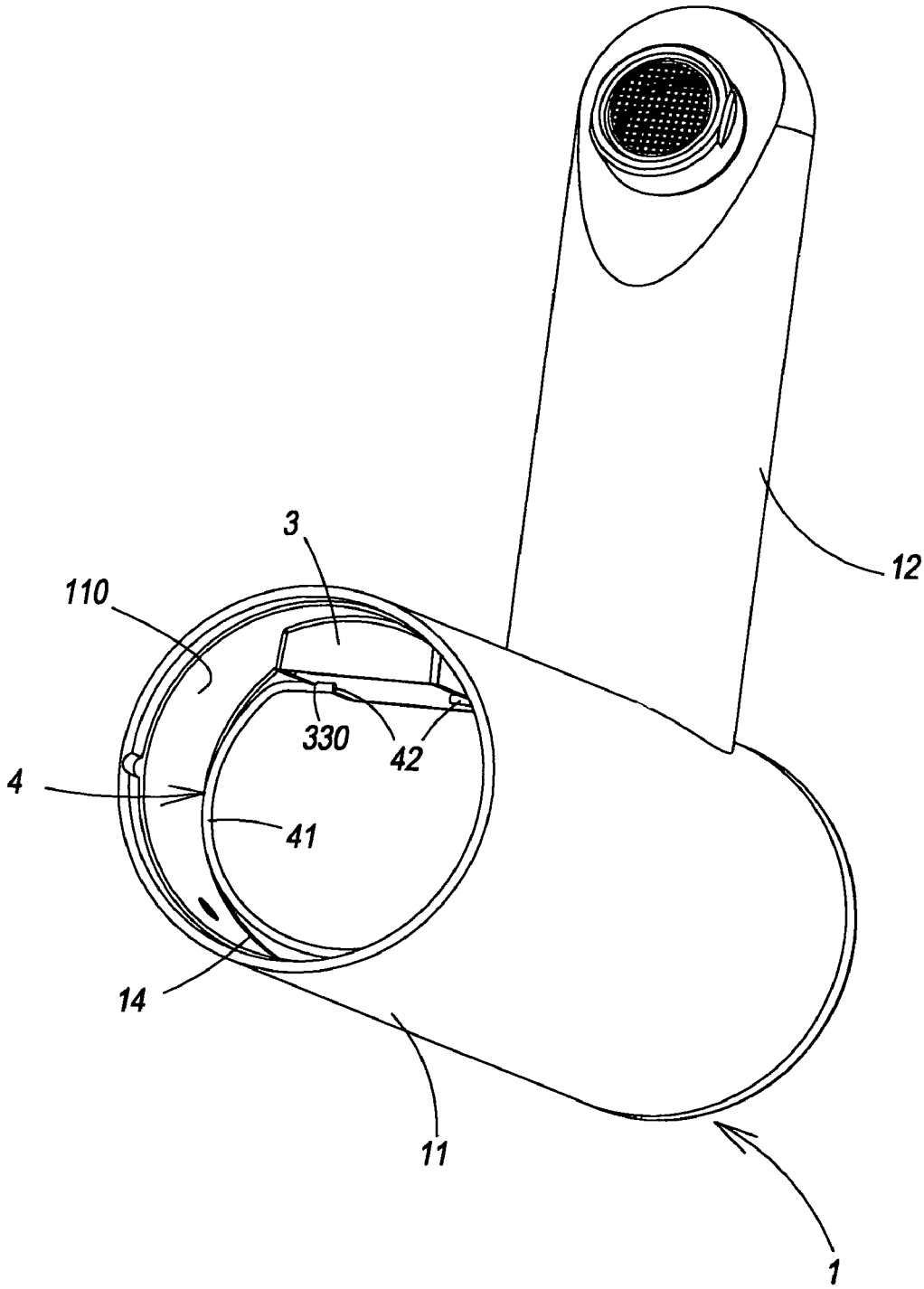
FIG. 5 is a schematic view of an embodiment of the invention in an assembled and anchored condition.
Figure 6:
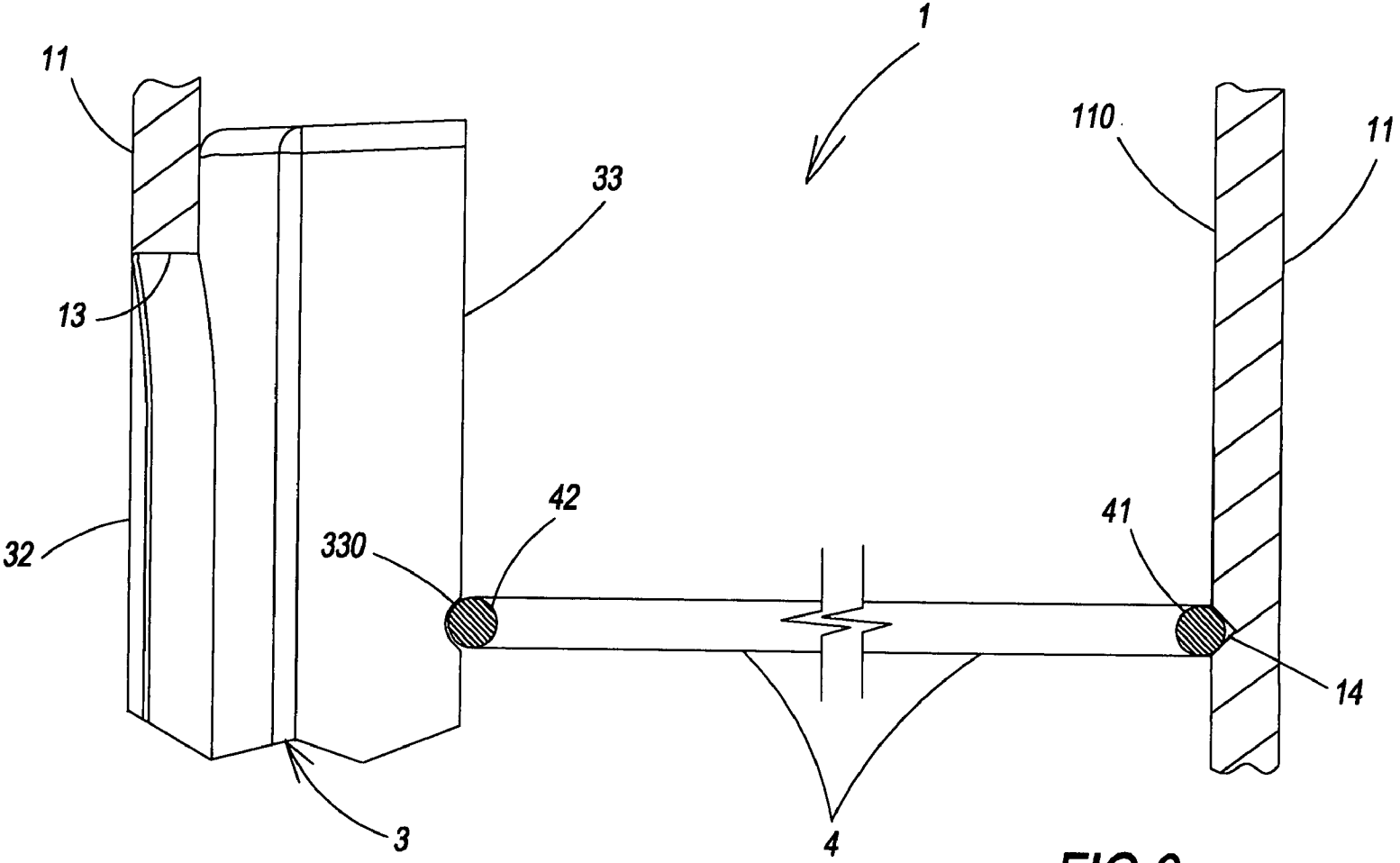
FIG. 6 is another schematic view of an embodiment of the invention in an assembled and anchored condition.

Referring to FIGS. 5 and 6, when in use the closed portion 41 of the elastic clipping ring 4 is wedged in the annular groove 14 while the opening 42 is latched in the notch 330 of the sensor 3 to form a multi-point bucking to anchor the sensor 3 securely inside the faucet 1 at where the port 13 is located. The closed portion 41 of the elastic clipping ring 4 can be fully latched in the annular groove 14 as shown in FIG. 6, or partially latched in the annular groove 14 as shown in FIG. 5. For the partially latching the closed portion 41 is preferably having at least two points in contact with the annular groove 14 at the same time.

Figure 7:
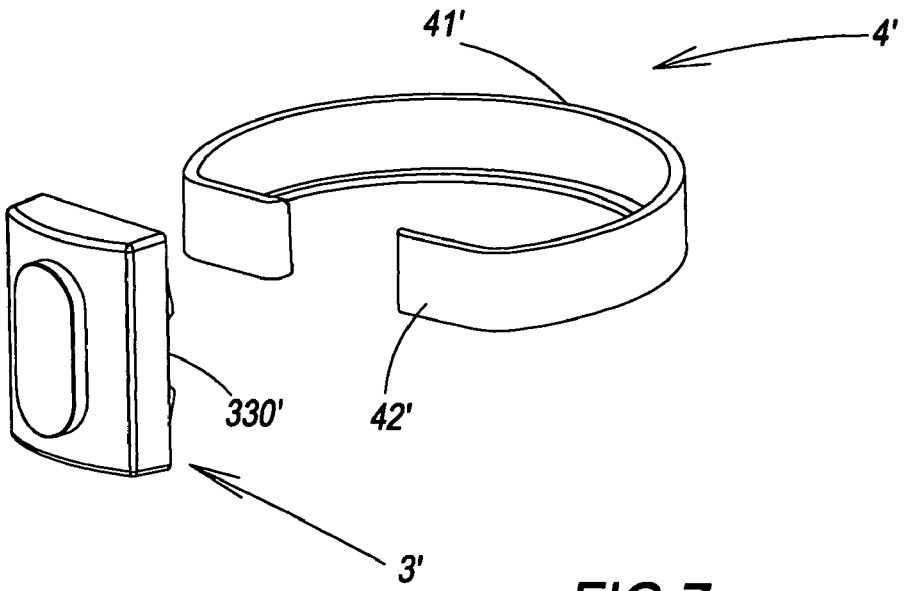
FIG. 7 is a perspective view of another embodiment of the invention showing the sensor and the elastic clipping ring.
Figure 8:
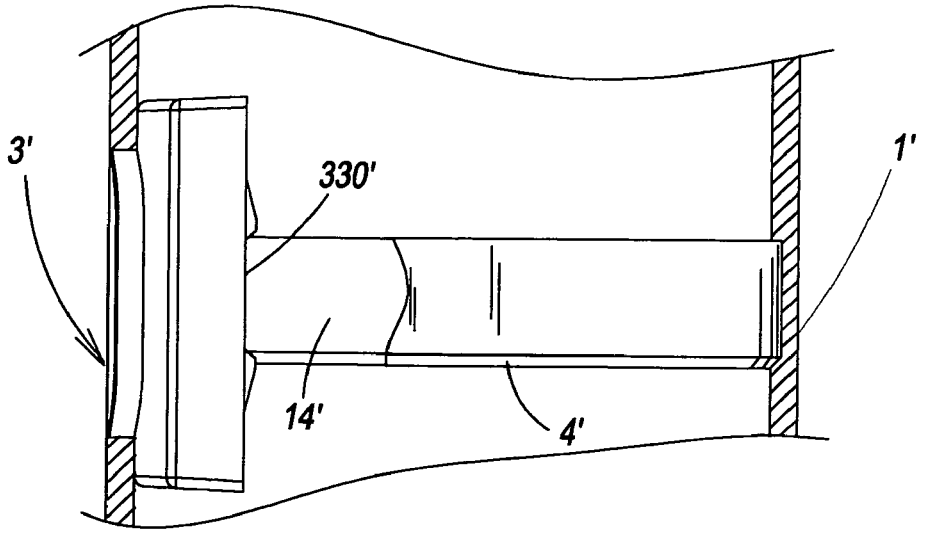
FIG. 8 is a schematic view of another embodiment of the invention showing the sensor and the elastic clipping ring in an assembled and anchored condition.

Referring to FIGS. 7 and 8, the elastic clipping ring 4 may also be a blade type elastic ring 4' with a selected width, and also has a closed portion 41' and an opening 42'. The mating sensor 3' has a notch 330' at a corresponding width. Hence the elastic clipping ring may be formed in any shapes, and the notch is formed in a corresponding and latchable shape. As shown in FIG. 8, the closed portion 41' is latched in the annular groove 14' on the inner wall of the faucet 1', and the opening 42' is latched in the notch 330' of the sensor 3' to form an anchor and bucking effect.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

I claim:

1. An anchor structure for sensors of faucets adopted for use on a sensing faucet which has a hollow body with a port formed thereon, the faucet housing a water supply valve and a sensor which has a detection side on one side to be wedged in the port, comprising:

an annular groove on a circumference on an annular inner wall of the body where the port is located, the sensor having at least one notch on an anchor side opposite to the detection side at an elevation same as the annular groove; and an elastic clipping ring that is latched in the annular groove and latched in the notch of the sensor in order to anchor the sensor on a selected location in the faucet.

2. The anchor structure of claim 1, wherein the annular groove is an indented annular groove formed on the inner wall of the body.

3. The anchor structure of claim 1, wherein the annular groove has a cross section selectively formed in a shape of a saw, a curve, a rectangle or a desired geometric shape.

4. The anchor structure of claim 1, wherein the notch of the sensor is selectively formed in a shape of a saw, a curve, a rectangle or a desired geometric shape.

5. The anchor structure of claim 1, wherein the elastic clipping ring is a non-closed annular elastic element and has an opening.

6. The anchor structure of claim 1, wherein the elastic clipping ring has a closed portion which has two straight end portions opposing each other to form an opening therebetween.

7. The anchor structure of claim 1, wherein the elastic clipping ring has a closed portion wedged in the annular groove and an opening latched in the notch of the sensor.

8. The anchor structure of claim 7, wherein the closed portion of the elastic clipping ring is latched tightly with the annular groove.

9. The anchor structure of claim 7, wherein the closed portion of the elastic clipping ring is partially latched in the annular groove.

10. The anchor structure of claim 9, wherein the closed portion of the elastic clipping ring has at least two points in contact simultaneously with the annular groove.

11. The anchor structure of claim 6, wherein each of the two straight end portions of the elastic clipping ring is fitted into the notch on the anchor side of the sensor.

12. The anchor structure of claim 1, wherein the elastic clipping ring is biased outwardly into the annular groove on the inner wall of the hollow body and into the notch of the sensor.

13. An anchor structure for sensors of faucets adopted for use on a sensing faucet which has a hollow body with a port formed thereon, the faucet housing a water supply valve and a sensor which has a detection side on one side to be wedged in the port, comprising:

an annular groove on a circumference on an annular inner wall of the body where the port is located, the sensor having at least one notch on an anchor side opposite to the detection side at an elevation same as the annular groove; and an elastic clipping ring having an outer side thereof that is latched in the annular groove on the inner wall of the body and latched in the notch of the sensor in order to anchor the sensor on a selected location in the faucet.

14. The anchor structure of claim 13, wherein the elastic clipping ring is biased outwardly into the annular groove on the inner wall of the hollow body and into the notch of the sensor.

* * * * *